US012490782B1

(12) United States Patent
Olynick

(10) Patent No.: US 12,490,782 B1
(45) Date of Patent: Dec. 9, 2025

(54) UPPER-TORSO GARMENT WITH HOOD AND INTEGRAL SCARVES AND BODICE

(71) Applicants: NIKE, Inc., Beaverton, OR (US); ENI-JR286, Inc., Torrance, CA (US)

(72) Inventor: Ruth Olynick, Hermose Beach, CA (US)

(73) Assignee: NIKE, Inc., Beaverton, OR (US)

( * ) Notice: Subject to any disclaimer, the term of this patent is extended or adjusted under 35 U.S.C. 154(b) by 0 days.

(21) Appl. No.: 18/737,369

(22) Filed: Jun. 7, 2024

(51) Int. Cl.
*A41D 23/00* (2006.01)
*A41D 3/00* (2006.01)

(52) U.S. Cl.
CPC ..... *A41D 3/00* (2013.01); *A41D 23/00* (2013.01); *A41D 2200/20* (2013.01)

(58) Field of Classification Search
CPC .. A41D 23/00; A41D 2023/004; A41D 15/00; A41D 2200/20; A41D 2300/33; A41D 2300/332; A42B 1/045; A42B 1/04; A42B 1/046
See application file for complete search history.

(56) References Cited

U.S. PATENT DOCUMENTS 975,667 A * 11/1910 Wolfe ..... A41B 13/10 2/200.2
1,068,146 A 7/1913 Loeffelholz
1,203,870 A * 11/1916 Hallam et al. ..... A42B 1/045 2/203
1,211,807 A * 1/1917 Aidenland ..... A42B 1/045 2/203
1,414,558 A * 5/1922 Ensten ..... A42B 1/041 2/172
2,313,458 A * 3/1943 Tucker ..... A42B 1/045 2/84
2,417,888 A * 3/1947 Schuster ..... A41D 1/215 D2/854
2,439,382 A * 4/1948 De Grazla ..... A42B 1/048 2/84

(Continued)

FOREIGN PATENT DOCUMENTS

CA 2697105 A1 9/2011
CN 211157039 U 8/2020

(Continued)

OTHER PUBLICATIONS

"Women's UA Extended Sports Hijab", Available at : <https://www.underarmour.com/en-us/search/?q=UA extended sports hijab>, 16 pages.

(Continued)

*Primary Examiner* — Jillian K Pierorazio
(74) *Attorney, Agent, or Firm* — Shook, Hardy & Bacon L.L.P.

(57) ABSTRACT

This disclosure relates to an upper-torso garment, which includes a hood combined with various additional useful features, such as an integral bodice and integral multi-functional scarves. The integral bodice can include various fasteners for securing the upper-torso garment about the torso of the user. A scarf may be affixed to each side of the hood such that each scarf drapes down below a face opening in the hood. When worn, the scarves may remain in a draped configuration or may be wrapped around the user's neck, hair or torso as desired.

12 Claims, 6 Drawing Sheets

(56) References Cited

U.S. PATENT DOCUMENTS

| | | | | | |
|---|---|---|---|---|---|
| 2,499,689 | A * | 3/1950 | Sossamon | A41B 13/10 | 2/48 |
| 2,524,775 | A * | 10/1950 | De Grazia | A42B 1/045 | 2/88 |
| 2,581,366 | A * | 1/1952 | De Grazia | A42B 1/045 | 2/84 |
| 2,800,901 | A | 7/1957 | Monro | | |
| 2,870,452 | A * | 1/1959 | De Grazia | A42B 1/048 | 2/84 |
| 3,144,660 | A | 8/1964 | Portaro | | |
| 3,555,566 | A * | 1/1971 | Gettinger | A42B 1/045 | 2/204 |
| 5,007,115 | A * | 4/1991 | Denbow | A41D 23/00 | 2/202 |
| 5,153,945 | A * | 10/1992 | Kobayashi | A41D 3/04 | 2/202 |
| 5,293,646 | A | 3/1994 | Winston | | |
| 5,339,466 | A | 8/1994 | McMullen | | |
| 5,605,144 | A * | 2/1997 | Simmons | A42B 3/10 | 2/171.2 |
| 6,370,692 | B1 * | 4/2002 | Duyn | A41D 3/02 | 2/202 |
| D555,330 | S * | 11/2007 | Cass | D2/866 | |
| 7,467,422 | B2 * | 12/2008 | Bugarin | A42B 1/046 | 2/202 |
| D621,591 | S * | 8/2010 | Gloege | D2/880 | |
| D693,096 | S * | 11/2013 | Russo | D2/866 | |
| D697,286 | S * | 1/2014 | Allen | D2/840 | |
| D699,927 | S * | 2/2014 | Fujioka | D2/881 | |
| D708,822 | S * | 7/2014 | Douglas | D2/880 | |
| D709,671 | S * | 7/2014 | Field | D2/831 | |
| D717,524 | S | 11/2014 | Allen et al. | | |
| 9,364,038 | B2 * | 6/2016 | Barrett | A42B 1/048 | |
| D770,731 | S | 11/2016 | Norman et al. | | |
| 9,907,381 | B2 | 3/2018 | Tussey | | |
| 10,070,674 | B1 * | 9/2018 | Beckers | A41D 27/00 | |
| 10,149,503 | B2 | 12/2018 | Bersamin | | |
| 10,271,594 | B1 * | 4/2019 | Cook | A41D 13/1245 | |
| D954,399 | S * | 6/2022 | Tatarchuk | D2/831 | |
| 11,357,276 | B2 * | 6/2022 | Thornton | A41F 9/00 | |
| 11,388,937 | B2 | 7/2022 | Nachawati | | |
| 2003/0200594 | A1 * | 10/2003 | McGreggor | A42B 1/041 | 2/202 |
| 2005/0039702 | A1 * | 2/2005 | Laffoon | A01K 27/00 | 119/850 |
| 2005/0050612 | A1 * | 3/2005 | Larson | A42B 1/046 | 2/203 |
| 2005/0132471 | A1 * | 6/2005 | McGreggor | A42B 1/049 | 2/202 |
| 2007/0028366 | A1 * | 2/2007 | Weis | A41D 25/00 | 2/244 |
| 2010/0242158 | A1 * | 9/2010 | Blakely | A41D 13/0512 | 2/461 |
| 2011/0004971 | A1 * | 1/2011 | Benderradji | A42B 1/048 | 2/202 |
| 2011/0225699 | A1 | 9/2011 | Elhamsadat et al. | | |
| 2012/0066812 | A1 * | 3/2012 | Alzate | A41D 27/20 | 2/202 |
| 2012/0137407 | A1 * | 6/2012 | Dimuzio | A42B 1/048 | 2/207 |
| 2012/0204323 | A1 * | 8/2012 | Park | A41D 23/00 | 2/202 |
| 2013/0152289 | A1 * | 6/2013 | Blakely | A41D 13/0512 | 2/461 |
| 2013/0247275 | A1 * | 9/2013 | Javad | A42B 1/16 | 2/203 |
| 2014/0109287 | A1 * | 4/2014 | Ramirez | A42B 1/04 | 2/84 |
| 2014/0259334 | A1 * | 9/2014 | Mitchell | A41D 23/00 | 2/461 |
| 2014/0325736 | A1 * | 11/2014 | Gersten | A42B 1/048 | 2/84 |
| 2016/0198830 | A1 * | 7/2016 | Tussey | A42B 1/049 | 2/183 |
| 2017/0164668 | A1 * | 6/2017 | Bersamin | A41D 27/201 | |
| 2017/0181484 | A1 * | 6/2017 | Ozbek | A47K 10/02 | |
| 2018/0064180 | A1 * | 3/2018 | Dickson | A41D 1/215 | |
| 2018/0092417 | A1 * | 4/2018 | Klar | A41D 23/00 | |
| 2019/0200739 | A1 * | 7/2019 | Green Mullins | A41D 13/0012 | |
| 2020/0100551 | A1 * | 4/2020 | Lee | A41D 15/04 | |
| 2021/0015186 | A1 * | 1/2021 | Winegan | A41D 15/00 | |
| 2021/0037898 | A1 * | 2/2021 | Bednar | A41D 3/02 | |
| 2022/0022583 | A1 * | 1/2022 | Royal | A42B 1/045 | |
| 2022/0256958 | A1 * | 8/2022 | Brock | A42B 1/045 | |

FOREIGN PATENT DOCUMENTS

| | | | |
|---|---|---|---|
| CN | 215228731 | U | 12/2021 |
| DE | 1830913 | U | 5/1961 |
| MA | 30105 | B1 | 1/2009 |
| WO | 2022/066182 | A1 | 3/2022 |

OTHER PUBLICATIONS

Alsharifa: "Laguna Long-Tunic Islamic Swinsuit", Available at: <https://shop.alsharifa.com/laguna-long-tunic-islamic-swimsuit/?>, 2006, 3 pages.

Artizara: "One Piece Stretch Sports Hijab—Cream", Available at: <https://www.artizara.com/products/one-piece-stretch-sports-hijab-cream>, 5 pages.

ViQ: "ViQ Long Sleeve Workout Top 2023", Zalora HongKong, 2023, 33 pages.

* cited by examiner

UPPER-TORSO GARMENT WITH HOOD AND INTEGRAL SCARVES AND BODICE

BACKGROUND

Hijabs are garments used as head coverings for a variety of purposes, for example, for covering a user's head, hair, neck and ears while leaving the user's face uncovered. Hijabs may be used during various activities, including work activities, social activities, athletic activities, and more. In addition, users often where hijabs as part of cultural, religious, historical and social events or requirements. Typical hijabs include a headscarf of various lengths and sizes that is wrapped around the user's head, hair, neck and ears in a manner that is comfortable for the user while providing the desired head covering function.

DETAILED DESCRIPTION OF DRAWINGS

The present articles of manufacture for an upper-torso garment with hood and integral scarves and bodice are described in detail below with reference to these figures.

DETAILED DESCRIPTION

Figure 1:
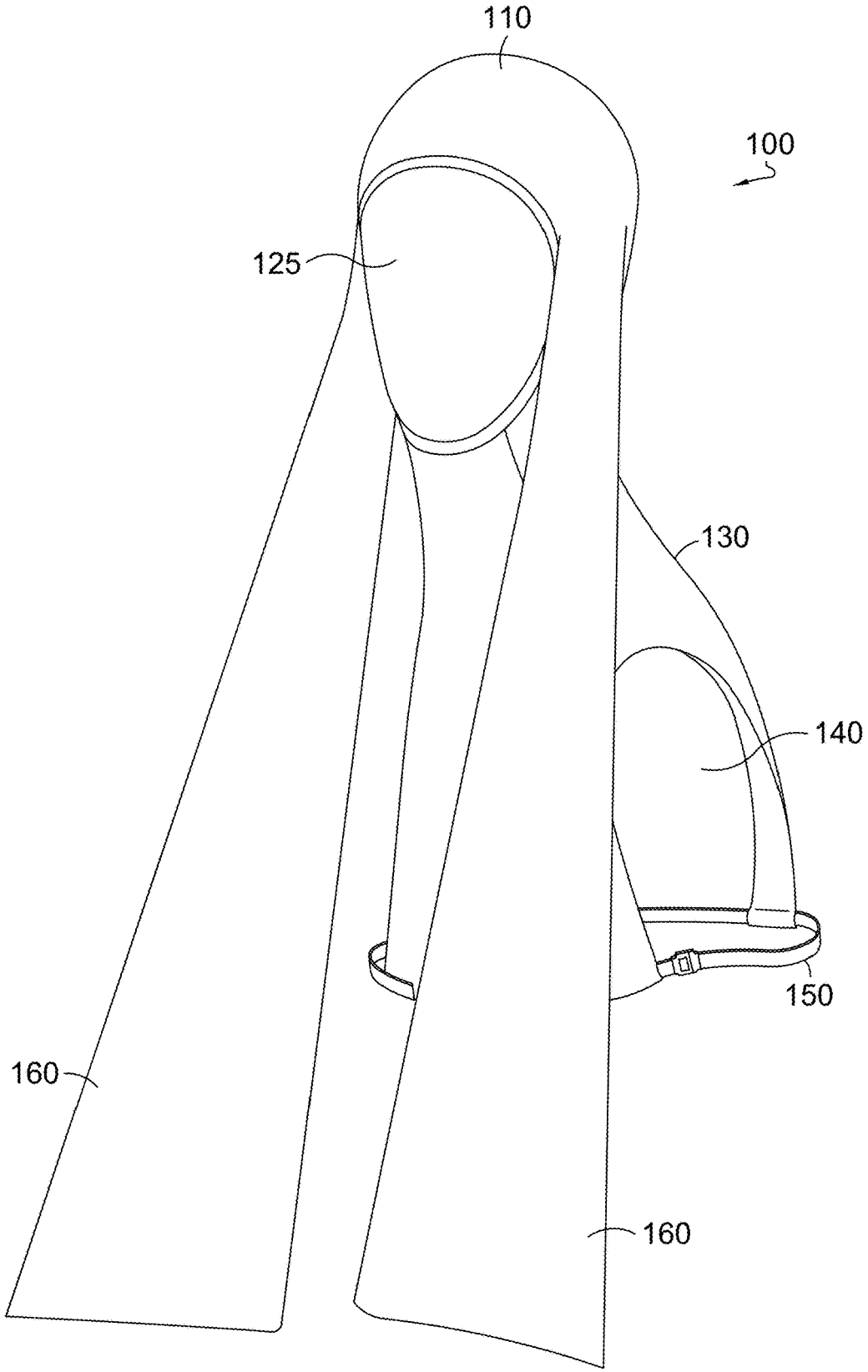
FIG. 1 depicts a perspective view of an upper-torso garment with integrated scarves and bodice, in accordance with examples of this disclosure.

This detailed description is directed to an upper-torso garment, which includes a hood combined with various additional useful features, such as an integral bodice and integral multi-functional scarves. In examples, a scarf may be affixed to each side of the hood such that each scarf drapes down below the hood's face opening. When worn, the scarves may remain in a draped position or may be wrapped around the user's neck, hair or torso as desired. In addition, the integral bodice can include various fasteners for securing the upper-torso garment about the torso of the user.

With some conventional hijabs, a single length of scarf may be used as a head covering. In such examples, the single length of scarf is wrapped about the user's head to cover the user's hair, neck and ears while leaving the user's face uncovered and visible. In other conventional examples, the scarf may be wrapped to cover the user's hair, ears, neck and a lower portion of the users face leaving only the user's eyes uncovered and visible. In still other conventional examples, the hijab scarf may be used to cover the user's entire head where a portion of the covering material that is wrapped over the user's eyes is configured to allow the user to see through the covering material for visibility. With such conventional hijabs, use of the head covering may be difficult in conditions that may cause the hijab to come loose or fall from the user's head. For example, if the user is outdoors in windy conditions, the hijab may be blown loose or off the user's head. For another example, if the user is engaged in activities of varying intensity such as athletics or a variety of work activities that include varying user movement speeds, erratic movements or physically stressful movements, such as jumping, tumbling, overhead lifting or other similar athletic or work activities, the hijab may come loose, become improperly adjusted or may fall from the user's head altogether. Such occurrences may lead to discomfort, interruption of user activity, or safety problems, for example, where the hijab shifts on the user's head and obstructs the user's vision.

In contrast to conventional hijabs, the upper-torso garment of the present disclosure includes a hood that can fit more securely. For example, the hood can include a face securing band (e.g., made from an elastic material) disposed around a perimeter of the face opening of the hood such that the face securing band holds the face opening snugly against the user's face and under the user's chin.

According to at least some examples, the hood may be comprised of one or more integrated panels that provide for a form fit to cover the user's head and to provide space in a rear portion of the head covering to accommodate the user's hair inside the head covering. According to at least one example, the panel in the rear portion of the head covering provides a bulge at the rear of the head covering to accommodate the user's hair so that tucking the user's hair inside the rear portion of the head covering does not cause the head covering to be pulled away from the forward portion of the user's head and face. Side panels of the head covering are formed to provide a snug fit of the head covering over the sides of the user's face and ears and under the user's jawline and chin and to the user's neck. As should be appreciated, the construction of the head covering may include a number of connected panels, for example, a top panel (e.g., apex) for the top of the user's head, a rear panel for the back of the user's head, a lower front panel for the neck area under the user's chin, and two side panels (one for each side of the head covering) for covering the side of the user's face and ears. The rear panel, the lower front panel and side panels may be of sufficient length to cover the user's neck when the head covering is donned. Alternatively, instead of top, lower front, rear and side panels that are combined to create the head covering, the head covering may comprise an integrated garment formed to cover the user's head, the sides of the user's face and ears and that provides a space in a rear portion of the head covering for the user's hair.

According to another example, a bodice is provided that extends downward from the head covering for securing the head covering and bodice combination to the user's torso for providing additional security against movement of the head covering on the user's head or off the user's head. According to one example, the bodice is affixed to or integrated with the portion of the head covering that covers the neck of the user. The bodice includes a rear component that extends from the rear portion of the head covering down the user's back. The bodice includes a front component that extends from a forward portion of the head covering under the user's chin and down the user's chest. On each side of the combined head covering and bodice, a gap is provided between the rear and front components of the bodice for the user's shoulders and arms to extend outward from the combined head covering and bodice components to allow free movement of the user's shoulders and arms.

Each of the rear and front components of the bodice may include an integrated elastic material for urging the rear and front components of the bodice against the back and chest of the user, respectively. According to one example, a belt, strap or band is affixed to or integrated with the rear or front components of the bodice for securing the rear and front components of the bodice to each other for providing a secure fit of the bodice around the user's torso. According to this example, a buckle, clasp or other suitable connective material (e.g., a Velcro strip) may be affixed to or integrated with one of the rear or front components of the bodice to allow the belt, strap, or band to secure the rear and front components of the bodice together. For example, a belt, strap or band may be affixed to a lower end of the rear component of the bodice for passing around the user's side from rear to front under the user's arm for connecting to a receiving buckle, clasp or other suitable connective system such that the rear and front components of the bodice are connected to each other around the user's torso for providing security from undesired movement of the head covering about or off the user's head.

According to additional examples, a scarf is affixed to or integrated with each side of the hood at a position above a lower edge of the sides of the hood. Each scarf is configured to drape from a respective side of the head covering to a length below the user's face sufficient to allow the scarf to be wrapped around the user's neck or torso or to allow the scarf to be tied around the rear portion of the head covering at a position where the user's hair creates an outwardly protruding bulge in the rear portion of the head covering. In at least some examples, the scarves may be tapered such that the ends of the scarves affixed to or integrated with the sides of the head covering are narrowed to avoid obstruction of the user's exposed face, but that are flared (widened) toward a lower terminating end to provide desired scarf material for wrapping around the user's neck, torso or rear portion of the head covering.

These and other aspects are described further below with reference to the accompanying drawings. The drawings are merely example implementations, and should not be construed to limit the scope of the claims.

FIG. 1 depicts a perspective view of an upper-torso garment with integrated scarves and bodice, in accordance with examples of this disclosure. According to examples, the upper-torso garment 100 (hereafter "hijab") includes a head covering or hood 110, a bodice 130 and a pair of scarves 160. The hijab 100 fits over a user's head and upper body or torso and may advantageously be used for warmth, support, sports, decoration, fashion, and the like, or the hijab 100 may be worn in association with one or more cultural or religious purposes. The head covering 110 fits over the head of a user and includes an opening 125 for exposing a user's face. According to other examples, the opening 125 may be covered with a visually permeable material, for example, a partially or totally see-through material that will allow a user's head and face to be covered, but that will allow a user to see through the covering over the opening 125.

Referring still to FIG. 1, according to examples, the hijab 100 includes an integrated bodice 130 extending below the head covering 110 and over the upper torso of the user. A gap 140 is provided in the bodice 130 for allowing the shoulders and arms of the user to extend out of the bodice 130. A belt or strap 150 is provided for securing a back portion of the bodice 132 to a front portion 134 of the bodice 130 around the torso of the user. A pair of scarves 160 are included that extend from each side of the head covering 110. As described in detail below, the scarves 160 may drape downward, as illustrated in FIG. 1, or the scarves 160 may be used for tying around the user's torso, neck or head as desired by the user.

According to examples, the hijab 100 may be made from a variety of suitable materials. For example the hijab 100 may be made from a lightweight moisture wicking material that is particularly useful when the hijab 100 is used in athletic situations, or when the hijab 100 is worn during higher temperatures and/or higher humidity environments. According to other examples, the hijab 100 may be made from a heavier weighted material, such as fleece, that is particularly useful in colder environments. As should be appreciated, any material used for clothing items may be used for the hijab 100.

Figure 2:
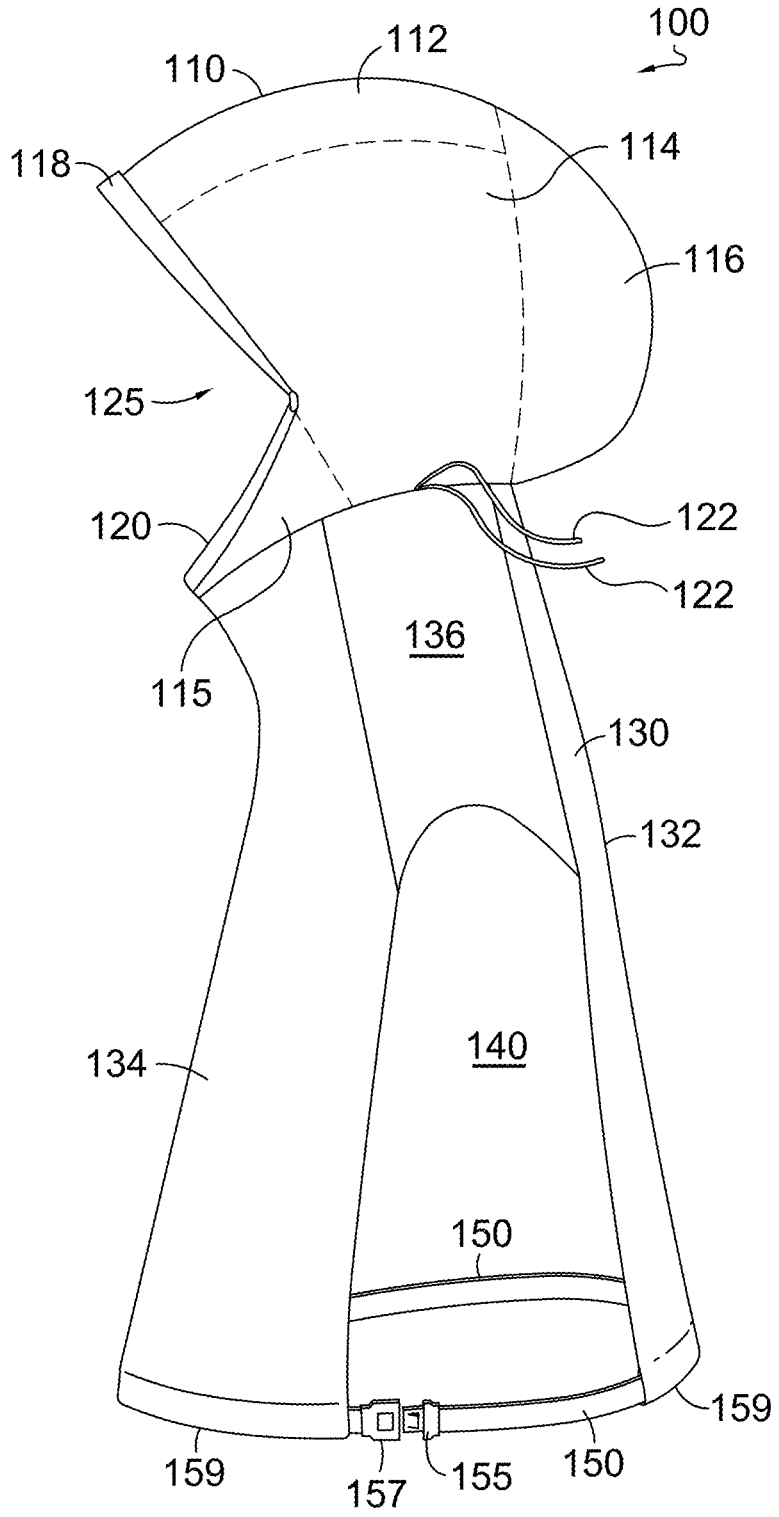
FIG. 2 depicts a side elevation view of the upper-torso garment of FIG. 1, showing the upper-torso garment with the integrated bodice of FIG. 1, but without the integrated scarves of FIG. 1, in accordance with examples of this disclosure.

FIG. 2 depicts a side elevation view of the upper-torso garment of FIG. 1, showing the upper-torso garment with the integrated bodice of FIG. 1, but without the integrated scarves of FIG. 1, in accordance with examples of this disclosure. According to examples, the head covering 110 of the hijab 100 may be provided from a single garment piece, or the head covering 110 may be constructed from one or more panels. Referring still to FIG. 2, according to one example, the head covering 110 includes a top portion or panel 112 (e.g., apex at the topmost portion when the hood is up) for covering a top portion of a user's head. A rear portion 116 may be included for covering the back portion of a user's head. According to this example, the rear portion 116 may be configured for tightly fitting over the backside of the user's head, or as illustrated in FIG. 2, the rear portion 116 may be configured with an enlarged area or "bulge" to allow the rear portion 116 to encase and support a user's hair bunched or tied behind the user's head.

According to examples, the head covering or hood 110 may also include a pair of side portions or panels 114 configured to cover the sides of a user's face. A lower front portion 115 of the head covering or hood 110 is illustrated for covering a portion of the user's neck beneath the user's chin. According to examples, each of the portions 112, 114, 115, 116 of the head covering 110 may be constructed from separate pieces of material that may be combined together to form the head covering 110. Alternatively, the head covering 110 may be constructed from a single piece of material that includes each of the portions or panels 112, 114, 115, 116 as illustrated in FIG. 2.

Referring still to FIG. 2, according to an example, the head covering or hood 110 may include a band 118 for fitting the face opening 125 about an upper portion of the user's face. A band 120 may be included for fitting the face opening 125 about a lower portion (e.g., beneath the chin) of the user's face. According to this example, the bands 118, 120 may be made from the same material as other portions of the head covering 110, or the bands 118, 120 may be made from a different material than other portions of the head covering 110. For example, the bands 118, 120 may be made from one or more decorative materials or may include one or more decorative designs. Alternatively, the bands 118, 120 may be made from an elastic material that urges the face opening 125 tightly or snuggly about the user's face. Urging the opening 125 tightly or snuggly about the user's face is particularly advantageous for securing the head covering 110 about the user's face during athletic activities, or for keeping the users head warm, or for keeping the user's hair secured inside the head covering 110.

Referring still to the head covering 110, a pair of drawstrings or cords 122 is illustrated for tightening the head covering 110 about the user's neck. In FIG. 2, the drawstrings or cords 122 are illustrated extending behind the user's neck, but according to one example, the drawstrings or cords 122 may extend below the user's chin to allow the user to selectively tighten the head covering 110 around the user's neck for keeping the head covering 110 secure while in use. In some examples, the cords 122 can extend to the interior of the garment and out of view. That is, the cords 122 can be stowed inside the garment so as to avoid interfering with activities. In some examples, an opening along the perimeter edge of the face opening is positioned on the internal portion of the face-opening perimeter edge so as to allow the cords to extend to the interior and out of view.

Referring still to FIG. 2, the bodice 130 extends from a bottom edge of the head covering 110 and down over the user's upper torso. According to examples, the bodice 130 provides a number of useful functions. The bodice 130 may keep the upper-torso garment or hijab 100 secured on the user which is particularly useful when the user engaged in an athletic activity. The bodice 130 may also provide for warmth in colder environments. In addition, if the upper-torso garment or hijab 100 is worn as an outer garment, the back and front portions 132, 134 of the bodice (described below) may also serve as decorative or fashion-oriented spaces for different colors, patterns, logos, advertisements, and the like.

According to examples, the bodice 130 includes a rear or back portion 132 that extends from beneath the rear portion 116 of the head covering 110. The rear or back portion 132 of the bodice extends downward along the user's back and may terminate at any of a number of desired positions, for example, upper-torso, mid-torso, or waistline. A front portion 134 of the bodice 130 extends from beneath the lower or front portion 115 of the head covering 110. The front portion 134 of the bodice 130 extends downward to a distance similar to or equal to the downward distance of the rear or back portion 132 to a number of desired positions, for example, upper-torso, mid-torso or waistline.

According to one example, a panel or portion 136 is provided that extends from beneath the side portions 114 of the head covering 110 downward to an upper opening or gap 140 through which the user's shoulders and arms extend between the rear and front portions 132, 134 of the bodice 130. According to this example, the panel or portion 136 may extend over the user's shoulders from the user's side neck area to a position where the gap 140 begins. As described above with reference to the head covering 110, the portions, panels or components 132, 134, 136 of the bodice may be made from separate pieces of material that are combined to form the bodice 130 that is then attached to the head covering 110. Alternatively, the portions, panels or components 132, 134, 136 of the bodice 130 may be made from a single piece of material that is then attached to the head covering 110. According to another alternative, the combined head covering 110 and bodice 130 may be made from a single piece of material instead of a combination of separate pieces of material.

Referring still to FIG. 2, a strap or belt 150 is illustrated along a lower edge of the rear and front portions 132, 134 of the bodice 130. According to examples, the belt or strap 150 provides for connecting the rear portion 132 of the bodice 130 to the front portion 134 of the bodice 130 for securing the bodice around the torso of the user. According to one example, as illustrated in FIG. 2, the belt or strap 150 may be attached to a lower edge of either the rear portion 132 of the bodice 130 at a position at which the gap 140 begins on each side of the rear portion 132 for connection to a lower edge of the front portion 134 of the bodice 130. Alternatively, the belt or strap 150 may emanate from each side of the front portion 134 for connecting to the rear portion 132 of the bodice 130. In either case, the strap 150 may include a buckle 155 positioned at a terminating end of the strap 150 configured for attachment to an awaiting buckle receiver 157 to allow the rear portion 132 of the bodice 130 to be connected to the front portion 134 of the bodice 130. According to examples, the buckle 155 and buckle receiver 157 may be in the form of any suitable attachment means, for example, a clasp or connection material such as a hook and loop fastener material.

According to examples, the belt or strap 150 may be part of a band 159 that is integrated along the lower edge of the rear and front portions 132, 134 of the bodice 130. According to one example, the band 159 and/or the strap 150 may be made from an elastic material that further aids in snugly fitting the bodice 130 around the torso of the user.

Figure 3:
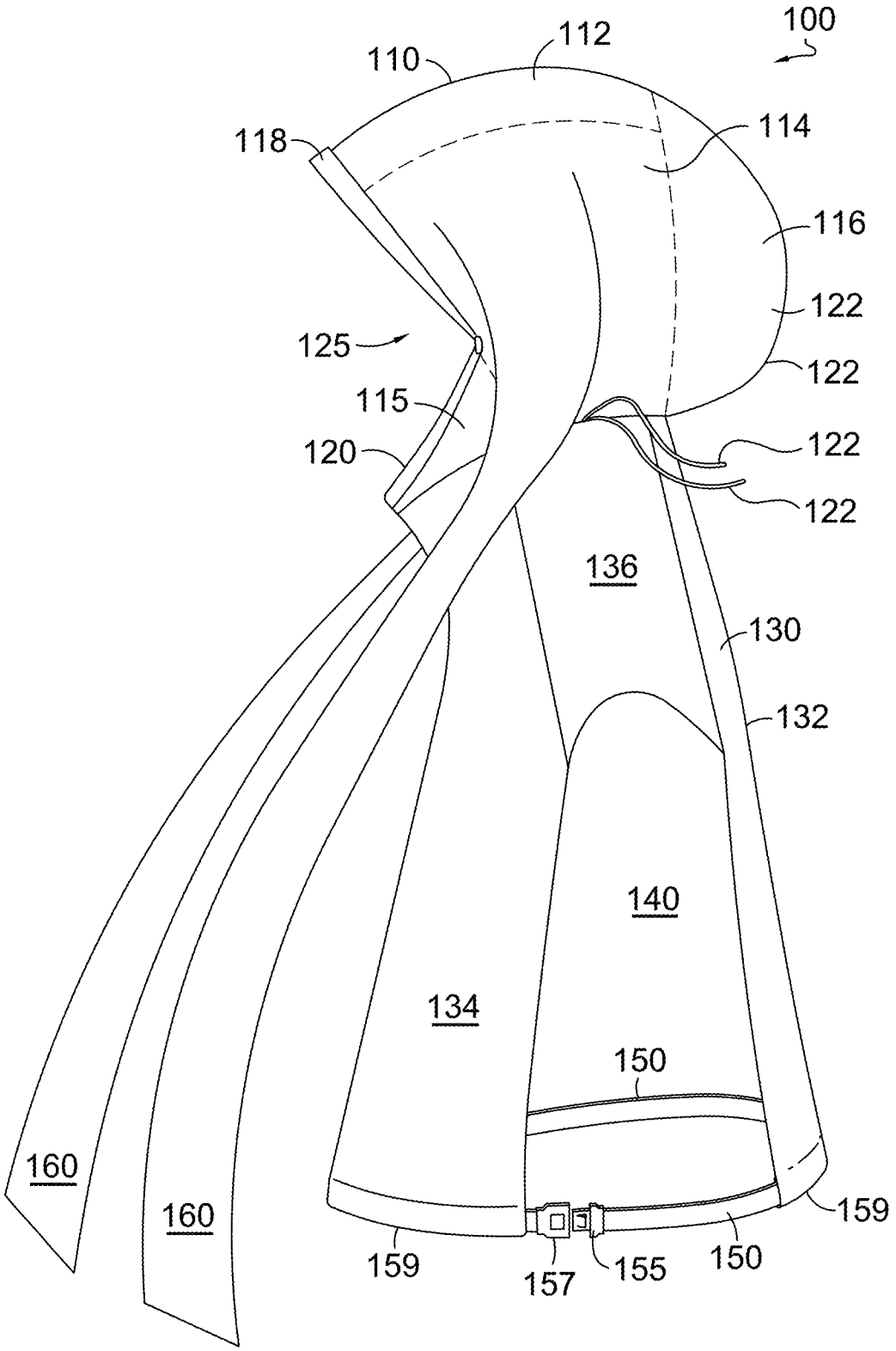
FIG. 3 depicts a side elevation view of the upper-torso garment with hood and integral scarves and bodice of FIG. 1, showing the integrated scarves in a forward draped configuration, in accordance with examples of this disclosure.

FIG. 3 depicts a side elevation view of the upper-torso garment with hood and integral scarves and bodice of FIG. 1, showing the integrated scarves in a forward draped configuration, in accordance with examples of this disclosure. As described above, according to examples, a scarf 160 may be affixed to each side of the side portion 114 of the head covering 110. The scarves 160 extend from each side of the head covering 110. The scarves 160 may drape downward, as illustrated in FIGS. 1 and 3, or the scarves 160 may be used for tying around the user's torso, neck or head as desired by the user. In FIG. 3, the scarves 160 are illustrated in a downward draping configuration. According to this configuration, the scarves 160 may serve as decorative or fashion-oriented additions to the upper-torso garment or hijab 100. For example, the scarves 160 may include decorative colors, patterns, logos, advertisements and the like as desired.

The scarves 160 may be made from the same material as the other components of the upper-torso garment or hijab 100. In this case, the scarves 160 may be made from separate pieces of material that are affixed to the side portions 114 of the head covering 110, or the scarves 160 may be made from a single piece of material from which the other components of the head covering 110 are made. Alternatively, the scarves 160 may be made from a different material as used for the other components of the hijab 100 that are then affixed to the side portions 114 of the head covering was 110.

Figure 4:
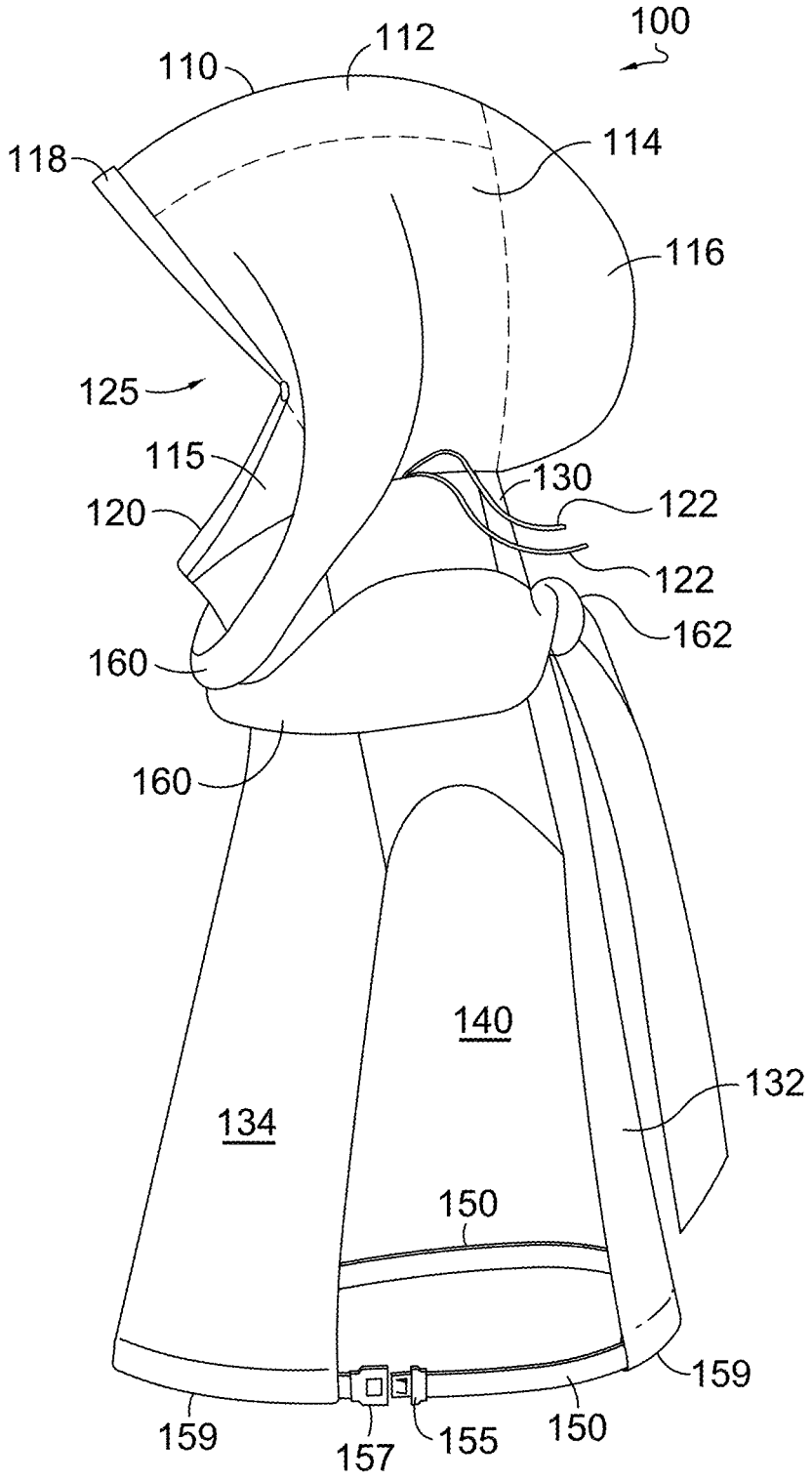
FIG. 4 depicts a side elevation view of the upper-torso garment with hood and integral scarves and bodice of FIG. 1, showing the integrated scarves pulled about the torso of a user and tied behind the user's torso, in accordance with examples of this disclosure.

According to examples, in addition to use of the scarves 160 in a downward draping configuration, as illustrated in FIG. 3, the scarves 160 may be used in a variety of other manners. FIG. 4 depicts a side elevation view of the upper-torso garment with hood and integral scarves and bodice of FIG. 1, showing the integrated scarves pulled about the torso of a user and tied behind the user's torso, in accordance with examples of this disclosure. As illustrated in FIG. 4, the scarves 160 are crossed over the user's chest and then pulled behind the user's torso. Behind the user's torso, the scarves 160 are tied together with knot 162 to secure the scarves behind the user's back. As should be appreciated, according to this configuration, the scarves 160 may be wrapped around the user at any number of positions along the user's torso (e.g., high-torso, mid-torso, waistline, etc.). Placement of the scarves 160 around the user's torso, as illustrated in FIG. 4, can provide for enhanced security against movement of the hijab 100, additional warmth, or simply may provide the user with desired aesthetics.

Figure 5:
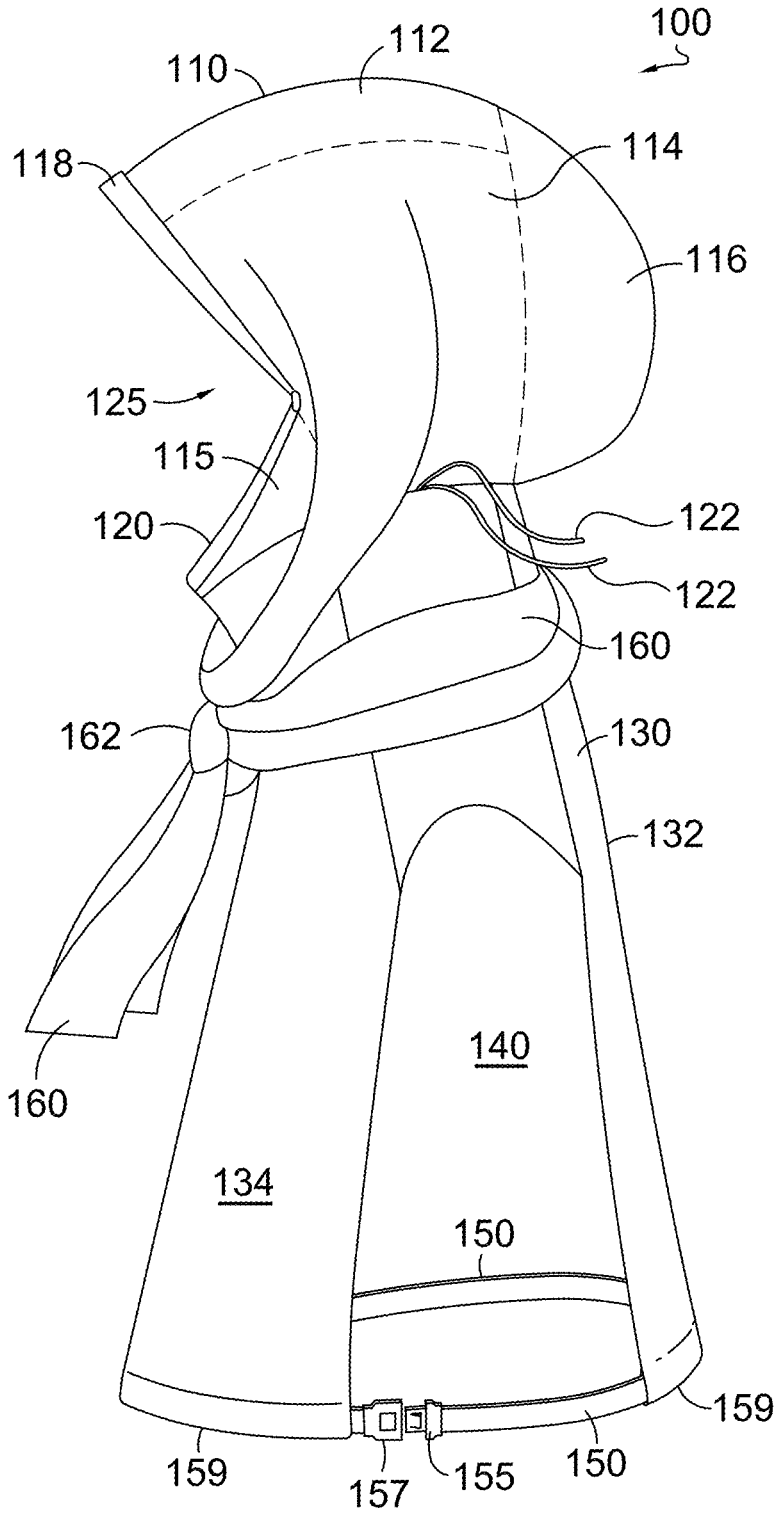
FIG. 5 depicts a side elevation view of the upper-torso garment with hood and integral scarves and bodice of FIG. 1, showing the integrated scarves pulled about the neck of a user and tied below the user's chin, in accordance with examples of this disclosure.

FIG. 5 depicts a side elevation view of the upper-torso garment with hood and integral scarves and bodice of FIG. 1, showing the integrated scarves pulled about the neck of a user and tied below the user's chin, in accordance with examples of this disclosure. As illustrated in FIG. 5, the scarves 160 are wrapped around the user's neck and are tied together under the user's chin with knot 162. As should be appreciated, according to this configuration, the scarves may be wrapped around the user's neck and tied behind the user's neck if desired. As with the torso wrapping configuration illustrated in FIG. 4, this example configuration may also provide for warmth or added security against movement of the hijab 100, or this configuration may simply provide the user with desired aesthetics.

Figure 6:
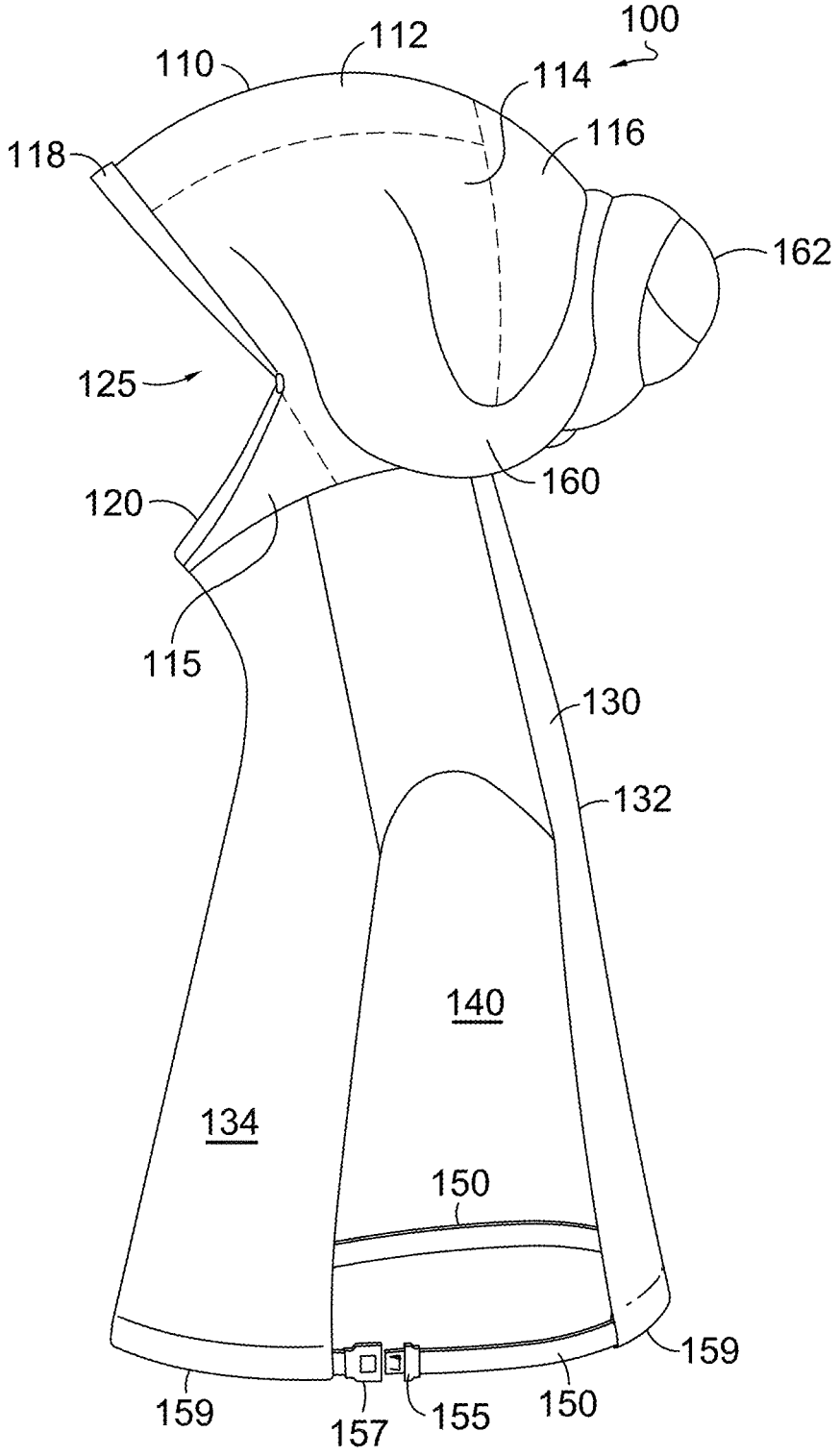
FIG. 6 depicts a side elevation view of the upper-torso garment with hood and integral scarves and bodice of FIG. 1, showing the integrated scarves pulled behind the back of the hood and about the hair of the user contained in the back of the hood, in accordance with examples of this disclosure.

FIG. 6 depicts a side elevation view of the upper-torso garment with hood and integral scarves and bodice of FIG. 1, showing the integrated scarves pulled behind the back of the hood and about the hair of the user contained in the back of the hood, in accordance with examples of this disclosure. In FIG. 6, another example use of the scarves 160 as illustrated. According to this example, the scarves 160 are wrapped around the rear portion 116 of the head covering 110 under which the user's hair is bunched or tied. Use of the scarves 160 according to this example allows the user to store the scarves out of the way of the user's arms or torso. Alternatively, use of the scarves 160, according to this example, allows the user to bind the user's hair inside the head covering 110, or use of the scarves according to this example may provide for a desired aesthetic. As should be appreciated, the configurations of the scarves 160 illustrated in FIGS. 3-6 are for purposes of example only and are not limiting of the many other configurations of the scarves 160 that may be utilized according to examples of the present disclosure.

EXAMPLE CLAUSES

A. An upper-torso garment comprising: a top portion configured for covering a top of a user's head; a rear portion configured for covering a back of a user's head; a lower front portion configured for covering a portion of a user's neck underneath the user's chin; a pair of side portions configured for covering the sides of a user's face; the upper-torso garment having a face opening configured for leaving a front of the user's face uncovered; and a scarf affixed to each side portion of the pair of side portions at a position above a lower edge of the upper-torso garment, the scarf extending downward below the lower edge of the upper-torso garment.

B. The upper-torso garment of Clause A, wherein each of the top portion, the rear portion, the lower front portion and the pair of side portions comprise separate panels of the upper-torso garment.

C. The upper-torso garment of Clauses A and B, wherein the rear portion panel is configured to form an outwardly extending bulge for containing a user's hair.

D. The upper-torso garment of Clause A, wherein the rear portion, the lower front portion and the pair of side portions extend downward over a user's neck.

E. The upper-torso garment of Clauses A and D, wherein a lower end of the scarf extends to a length substantially below the lower edge of the downwardly extending pair of side portions.

F. The upper-torso garment of Clauses A, D and E, wherein the scarf is tapered from a first width at an upper end of the scarf at which the scarf is affixed to each side portion of the pair of side portions to a second width at the lower end of the scarf.

G. The upper-torso garment of Clause A, further comprising a face opening support band disposed about a perimeter of the face opening configured for leaving a front of the user's face uncovered.

H. The upper-torso garment of Clauses A and G, wherein the face opening support band is an elastic band configured for urging the perimeter of the face opening against the user's face.

I. A clothing article, comprising: a head covering including a top portion, a rear portion, a lower front portion and a pair of side portions; the top portion configured for covering a top of a user's head; the rear portion configured for covering a back of a user's head; the lower front portion configured for covering a portion of a user's neck underneath the user's chin; the pair of side portions configured for covering the sides of a user's face; the head covering having a face opening configured for leaving a front of the user's face uncovered; and a bodice integrated with the head covering and extending below a lower edge of the head covering.

J. The clothing article of Clause I, wherein the bodice comprises: a rear component extending below the rear portion of the head covering; and a front component extending below the lower front portion of the head covering; and a gap between the rear component and the front component, the gap extending downward below each side portion of the pair of side portions, the gap configured to allow a user's shoulders and arms to protrude through the gap below each side portion of the pair of side portions.

K. The clothing article of Clauses I and J, wherein the rear and front components of the bodice include an integrated elastic material configured to urge the rear and front components against the user's torso.

L. The clothing article of Clauses I through K, wherein the bodice includes an attachment belt configured for attaching a lower end of the rear component to a lower end of the front component, the attachment belt extending across the gap between the rear component and the front component below each side portion of the pair of side portions.

M. The clothing article of Clauses I through L, further comprising an attachment buckle affixed to a lower end of each of first and second sides of the front component of the bodice for receiving the attachment belt from a lower end of each of first and second sides of the rear component of the bodice.

N. The clothing article of Clauses I through M, wherein the attachment belt is an elastic belt configured for urging the rear component of the bodice toward the front component of the bodice around the user's torso.

O. The clothing article of Clauses I through N, further comprising: a scarf affixed to each side portion of the pair of side portions at a position above a lower edge of the head covering, the scarf extending downward below the lower edge of the head covering.

P. The clothing article of Clauses I through O, wherein a lower end of the scarf extends to a length substantially below a lower edge of each side portion of the pair of side portions.

Q. The clothing article of Clauses I through P, wherein the scarf is tapered from a first width at an upper end of the scarf at which the scarf is affixed to each side portion of the pair of side portions to a second width at the lower end of the scarf.

R. A head and torso covering, comprising: a head covering including a top portion, a rear portion, a lower front portion and a pair of side portions; the top portion configured for covering a top of a user's head; the rear portion configured for covering a back of a user's head; the lower front portion configured for covering a portion of a user's neck underneath the user's chin; the pair of side portions configured for covering the sides of a user's face; the head covering having a face opening configured for leaving a front of the user's face uncovered; a bodice integrated with the upper-torso garment and extending below a lower edge of the upper-torso garment; and a scarf affixed to each side portion of the pair of side portions at a position above a lower edge of the upper-torso garment, the scarf extending downward below the lower edge of the upper-torso garment.

S. The head and torso covering of Clause R, wherein the bodice comprises: a rear component extending below the rear portion of the head covering; a front component extending below the lower front portion of the head covering; and a gap between the rear component and the front component, the gap extending downward below each side portion of the pair of side portions, the gap configured to allow a user's shoulders and arms to protrude through the gap below each side portion of the pair of side portions.

T. The head and torso covering of Clauses R and S, wherein the bodice further comprises: an attachment belt configured for attaching a lower end of the rear component to a lower end of the front component, the attachment belt extending across the gap between the rear component and the front component below each side portion of the pair of side portions; and an attachment buckle affixed to a lower end of each of first and second sides of the front component of the bodice for receiving the attachment belt from a lower end of each of first and second sides of the rear component of the bodice.

As used herein, a recitation of "and/or" with respect to two or more elements should be interpreted to mean only one element, or a combination of elements. For example, "element A, element B, and/or element C" may include only element A, only element B, only element C, element A and element B, element A and element C, element B and element C, or elements A, B, and C. In addition, "at least one of element A or element B" may include at least one of element A, at least one of element B, or at least one of element A and at least one of element B. Further, "at least one of element A and element B" may include at least one of element A, at least one of element B, or at least one of element A and at least one of element B.

This detailed description is provided in order to meet statutory requirements. However, this description is not intended to limit the scope of the invention described herein. Rather, the claimed subject matter may be embodied in different ways, to include different elements, and/or different combinations of elements, similar or equivalent to those described in this disclosure, and in conjunction with other present or future technologies. The examples herein are intended in all respects to be illustrative rather than restrictive. In this sense, alternative examples or implementations can become apparent to those of ordinary skill in the art to which the present subject matter pertains without departing from the scope hereof.

The invention claimed is:

1. A garment configured to cover a head and upper-torso, the garment comprising:

a hood combined with a bodice;

the hood comprising a face opening with a perimeter edge, the perimeter edge comprising an elastic band, and a pair of side portions on opposite sides of the face opening;

the bodice comprising a front portion and a back portion;

the front portion connected to the hood and extending down to a first lower terminal edge;

the back portion connected to the hood and extending down to a second lower terminal edge;

one or more adjustable fasteners connected to the first lower terminal edge and the second lower terminal edge; and a pair of scarfs, each connected to a respective middle portion of the hood and extending below the first lower terminal edge and the second lower terminal edge.

2. The garment according to claim 1, wherein each scarf flares from a narrower width at a top end connected to the respective side portion to wider width at a distal terminal end.

3. The garment according to claim 1, wherein the perimeter edge comprises a drawcord.

4. The garment according to claim 3, wherein a terminal end of the drawcord extends to an interior of the garment and is stowable.

5. The garment according to claim 1, wherein a gap extends between the front portion and the back portion, the gap configured to receive a wearer's arm when the garment is donned.

6. The garment according to claim 1 further comprising, a lower front portion configured for covering a portion of a user's neck underneath the user's chin.

7. The garment according to claim 1, wherein one or more of the first lower terminal edge and the second lower terminal edge comprise an elastic band.

8. The garment according to claim 1, wherein the one or more adjustable fasteners comprises an adjustable belt.

9. The garment according to claim 1, wherein the one or more adjustable fasteners comprises an elastic strap.

10. The garment according to claim 1, wherein the garment comprises a moisture-wicking material.

11. The garment according to claim 1, wherein the hood comprises a rear portion configured with an outward bulge.

12. The garment according to claim 1, wherein the face opening is covered with a visually permeable material.

* * * * *